US007178464B2

(12) United States Patent
Clark

(10) Patent No.: US 7,178,464 B2
(45) Date of Patent: Feb. 20, 2007

(54) RAIL CAR DOOR CLOSER

(76) Inventor: Gary Clark, P.O. Box 1023, Helotes, TX (US) 78023

( * ) Notice: Subject to any disclaimer, the term of this patent is extended or adjusted under 35 U.S.C. 154(b) by 113 days.

(21) Appl. No.: 10/977,337

(22) Filed: Oct. 28, 2004

(65) Prior Publication Data

US 2005/0120905 A1 Jun. 9, 2005

Related U.S. Application Data

(60) Provisional application No. 60/515,063, filed on Oct. 28, 2003.

(51) Int. Cl.
*B61D 7/00* (2006.01)

(52) U.S. Cl. ..... 105/241.2; 105/288; 414/378; 414/388

(58) Field of Classification Search ..... 105/247, 105/248, 240, 284, 241.2, 286, 287, 288, 105/289, 290; 414/388, 402, 372, 376, 377, 414/378, 387

See application file for complete search history.

(56) References Cited

U.S. PATENT DOCUMENTS 4,829,908 A * 5/1989 Hallam ..... 105/240
5,249,531 A 10/1993 Taylor
5,299,508 A 4/1994 Connelly
5,302,072 A 4/1994 Stauffer et al.
5,359,942 A * 11/1994 Ward ..... 105/240
5,419,262 A 5/1995 Turpin, Sr.
5,601,032 A 2/1997 Kosch
6,431,084 B1 * 8/2002 Gaydos ..... 105/247

* cited by examiner

*Primary Examiner*—Mark T. Le
(74) *Attorney, Agent, or Firm*—Kammer Browning PLLC

(57) ABSTRACT

A track mounted system for closing rail car doors that enables the simultaneous closing of multiple car doors. After hopper car contents such as aggregate or coal are unloaded, the doors are closed in pairs by semi-automated door closing arms that are positioned on the track and are operated by hydraulic cylinders, pneumatic cylinders, or electric motors. The closing arms are configured in specific shapes to adapt to a variety of hopper door configurations. The closing arms may be added in pairs depending on the number of doors. The door closer can be sequenced to accommodate frontward or rearward facing doors. Hydraulic cylinders with a differential bell crank can be used to activate the closer arm assemblies. Closer arms can be mounted side by side on the inside or outside of the track or separately inside and outside of the track.

10 Claims, 7 Drawing Sheets

RAIL CAR DOOR CLOSER

CROSS REFERENCE TO CORRESPONDING APPLICATIONS

This application claims the benefit under Title 35 U.S. Code §119(*e*) of U.S. Provisional Application No. 60/515,063 filed Oct. 28, 2003.

BACKGROUND OF THE INVENTION

1. Field of the Invention

The present invention pertains generally to rail car door closures. More specifically, the present invention relates to a system of paired rail door closing arm assemblies that enable the simultaneous closing of multiple rail car hopper doors.

2. Description of the Related Art

The present invention relates to an apparatus for the closure of rail car doors, specifically, the discharge doors of a coal or aggregate hopper car. These doors are extremely heavy and when open, extend vertically downward on hinges from the car frame. When closed, the doors are latched to the car frame and thus secured to prevent opening. When an aggregate or coal car reaches a delivery site, the doors are opened and the contents of the car emptied into receiving areas below the tracks. The car doors must be closed, of course, prior to departure from the site and reloading. The doors are extremely difficult to close manually and such an undertaking is very dangerous to the workers involved in such an operation. Severe injuries may result if a car door fails to latch, swings back open, and strikes a worker.

Various efforts have been made in the past to provide a mechanized system to close these rail car hopper doors. A solution to this problem is not simple as the delivery logistics, track and car configurations, and car door weight pose several challenges. Various rail car door closure devices have been designed to attempt to solve these problems. Examples of automated or partially automated approaches can be found in the following patent disclosures.

U.S. Pat. No. 5,299,508 issued to Connelly on Apr. 5, 1994 entitled RAILROAD CAR DOOR CLOSURE HAVING TRACKSIDE MOUNTED PLURAL ACTUATING ARMS describes a closer apparatus having two closer assemblies. The assemblies are mounted adjacent to each rail of a track on a frame that passes below and between the rails. Each assembly includes a hydraulic closer jack, a hydraulic lifting jack and a hydraulic swing motor for orienting the closer jack relative to a door. The jack is extendable to contact a door and push it to a closed position. The jack assemblies can be pivoted 180 degrees by the swing motor to close the forward door of the hopper and then the rearward door, without having to reposition the train.

U.S. Pat. No. 5,419,262 issued to Turpin Sr. on May 30, 1995 entitled RAILROAD HOPPER CAR DOOR CLOSER discloses a closer for hopper car doors including a supporting frame structure associated with the rails on which a series of hopper cars are positioned together with power actuated devices that pivot the hopper car doors from a generally closed position to a downwardly extending open position and thereafter pivot them about their supporting hinge back to a closed, latched position. The power devices include transversely extending support shafts with a pair of laterally extending rigid arms with each arm including a wheel at its outer end for engaging the hopper car doors when the transverse shafts are pivoted. The transverse shafts are pivoted by hydraulically operated piston and cylinder assemblies connected to a laterally extending arm on one end of each shaft. Activation devices are positioned in the path of movement of the hopper cars to activate the closer when the hopper car doors are in appropriate position for engagement.

U.S. Pat. No. 5,249,531 issued to Taylor on Oct. 5, 1993 entitled RAILROAD HOPPER CAR DOOR ACTUATING MECHANISM discloses an actuating system for operating the doors of a railroad hopper car. A plurality of levers for each hopper operate to rotate the doors of the hopper between an open and a closed position. The mechanism applies a tension force, rather than a compressive force, to push the doors closed. The mechanism also provides an over center latch to positively close each door. The mechanism may be used on either single or double hopper doors.

U.S. Pat. No. 5,302,072 issued to Stauffer et al. on Apr. 12, 1994 entitled TRACK SIDE DOOR CLOSING DEVICE FOR RAILWAY HOPPER CARS discloses a track side device for closing hopper doors which has an eccentrically rotatable wheel. The wheel rotates and contacts a hopper door to move it inward to a closed position. In a preferred embodiment, two devices are positioned on opposite sides of a railroad track to simultaneously close doors on both sides of the hopper car.

U.S. Pat. No. 5,601,032 issued to Kosch on Feb. 11, 1997 entitled APPARATUS FOR OPENING AND CLOSING RAILROAD HOPPER CAR DISCHARGE DOORS is directed to an apparatus for opening and closing the discharge doors of a railroad hopper car comprising a mounting frame secured to the hopper car forward of the discharge door. A pivot arm is secured to the mounting frame and has an air cylinder pivotally secured thereto that is interconnected to the pivot frame. Extension of the hydraulic cylinder causes the pivot frame to pivot with respect to the mounting frame thereby causing the adjustable linkage to open the door. Retraction of the cylinder rod into the cylinder causes the pivot frame to pivot with respect to the mounting frame to cause the adjustable linkage to close the discharge door.

Each of the above efforts to provide a rail car door closer suffers from excessive complexity and/or difficulty of use. It would be desirable to have a rail car door closer that is relatively inexpensive, operationally simple, and safe to use.

SUMMARY OF THE INVENTION

It is therefore an object of the present invention to provide an apparatus for closing rail car doors, such that multiple car doors could be closed at one time. It is a further object of the present invention to provide an apparatus for rail car door closure that is safe for workers and eliminates the need for manual door closure. Still another object of the present invention is to provide a rail car door closure apparatus that is of simple construction and operation, which achieves the stated objectives in an effective and relatively inexpensive manner, that solves the problems and satisfies the needs existing in the art.

In fulfillment of these and other objectives, the present invention provides a device that includes a rail car door closer system wherein the lifting of a plurality of appropriately positioned door closer arms is accomplished with hydraulic cylinders, pneumatic cylinders or electric motors. In using hydraulic or pneumatic cylinders, connections to the closer arms can be made with interconnected push-pull rods with swivel ball joints and/or clevis yokes that allow for an extreme arch of movement for the closing arms.

The closing arms are configured in shapes adapted to various styles of hopper doors. The closing arm assemblies may be added in pairs depending on the quantity of doors on a particular type of rail car. For example, the typical aggregate car will need six doors; a typical coal car, ten doors. The car door closer system will close half of the doors in one motion and the second half of the doors (facing the opposite direction) in the next motion. This ability makes the unit ideal for automation or semi-automation.

The swing doors on typical bottom discharge hopper car require that one door be closed before the other in order for the door latching mechanism to lock. A hopper car is often connected to other cars in such a manner that the first closing door might be forward and the next car might have the first closing door rearward. The door closer of the present invention can be sequenced to adapt to this situation, hence the first motion of the first set of closing arms can be for either forward facing doors or rearward facing doors.

The main frame of the closer assembly is a rectangular steel bar approximately 6" high by 2" wide. The bar extends beyond the unloading pit for securing at both ends. Cross members may also be added for support. The closer arms that are positioned on the main frame may be cut from ¾" flat plate steel and are each fitted with a welded boss to distance the closer arm from the main frame and to support closer arm rotation. Hydraulic cylinders may be used to actuate the closer arm assemblies. A differential bell crank can be used to actuate the closer arm assemblies to take advantage of a shorter stroke cylinder.

The closer arms may be mounted staggered from side-to-side on the main frame of the track or all on one side of the track. The closer arm push-pull rod lengths are adjusted to accommodate the positioning of the closer arms. Swivel ball or clevis yoke connections with in-board and out-board mounting on the closer arms are used to allow for clearance of the push-pull rods.

BRIEF DESCRIPTION OF THE DRAWINGS

A better understanding of the rail car door closer of the present invention may be had by reference to the drawing figures wherein.

DETAILED DESCRIPTION OF THE PREFERRED EMBODIMENT

Figure 1:
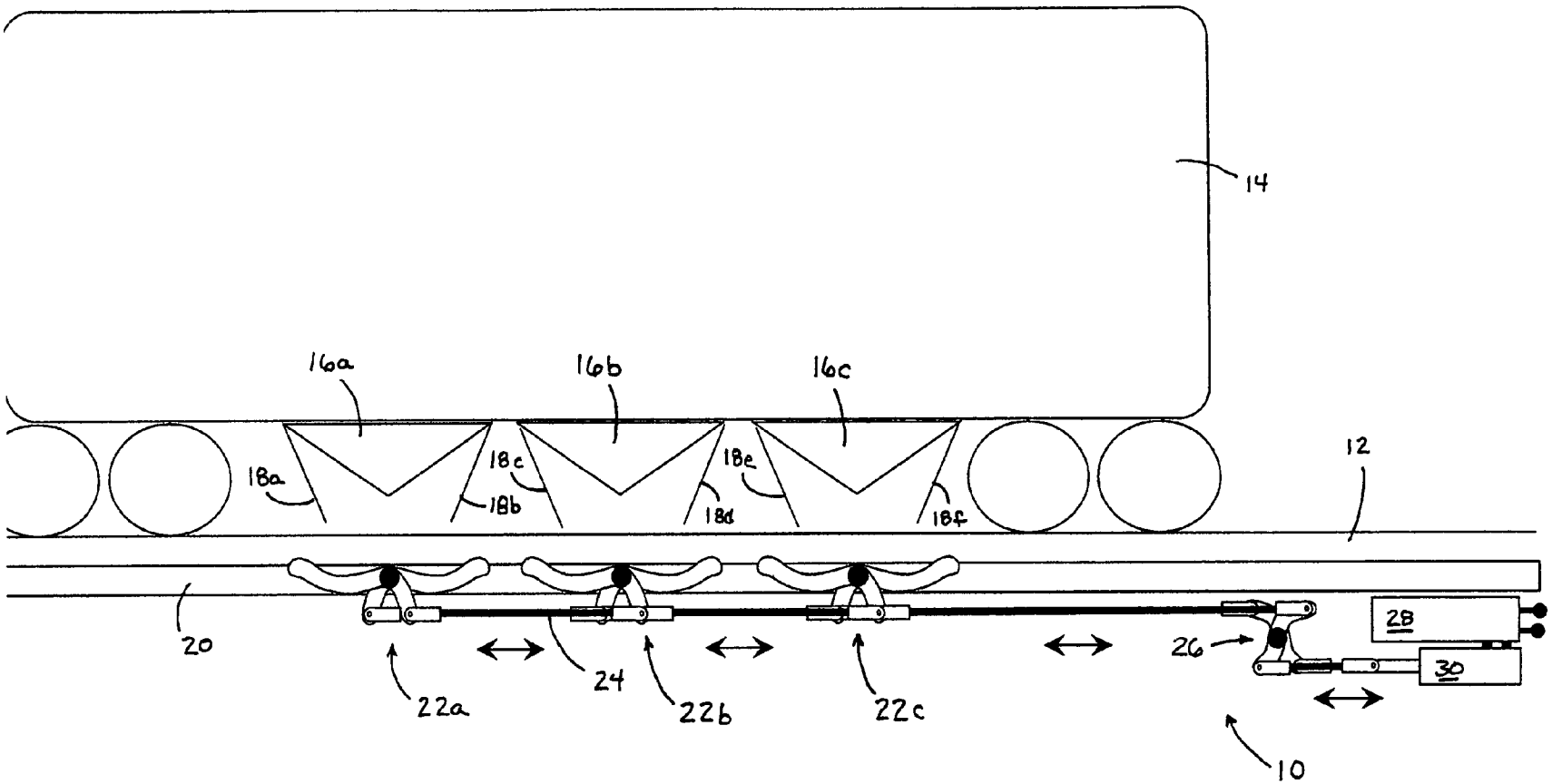
FIG. 1 is an overview of the system of the rail car and the car door closer mechanism of the present invention.

An overview of the various assemblies that together make up the rail car door closer system 10 of the present invention is shown in FIG. 1, wherein the rail car 14 is positioned on the rails 12 of a track with the hopper doors 18*a* & 18*b*, 18*c* & 18*d*, and 18*e* & 18*f* of hoppers 16*a*, 16*b* & 16*c*, open above the closer arm assemblies 22*a*, 22*b* & 22*c*. The closer arm assemblies 22*a*, 22*b* & 22*c* are pivotally positioned on main frame 20 and are connected in series by push-pull rods 24 to a bell crank assembly 26. The bell crank assembly 26 is connected to hydraulic cylinders 30 (one of which is shown) which are operably connected to hydraulic controls 28. Two push-pull rod linkage assemblies 24 are present, one positioned behind the other in the view of FIG. 1, the first associated with a first, left-hand set of closer arms and the second with a second, right-hand set of closer arms. Operation of the hydraulic cylinders 30 by way of lever actuated valves (as is known in the art) causes appropriate motion of the respective hydraulic cylinders 30 to rotate the appropriate bell crank assembly 26 components and alternately actuate the first or the second push-pull rod linkage assemblies 24. Movement of the first push-pull rod linkage assembly 24 causes the first set of (left-hand) closer arms to move against the left-hand hopper doors 18*a*, 18*c* & 18*e* and close them. These are held in place while the second push-pull linkage assembly (not visible) is actuated by a second hydraulic cylinder (not visible) and causes the second set (right-hand) of closer arms to move against the right-hand hopper doors 18*b*, 18*d* & 18*f* and close them over the first so as to latch the doors as is typical upon such closure.

Figure 2:
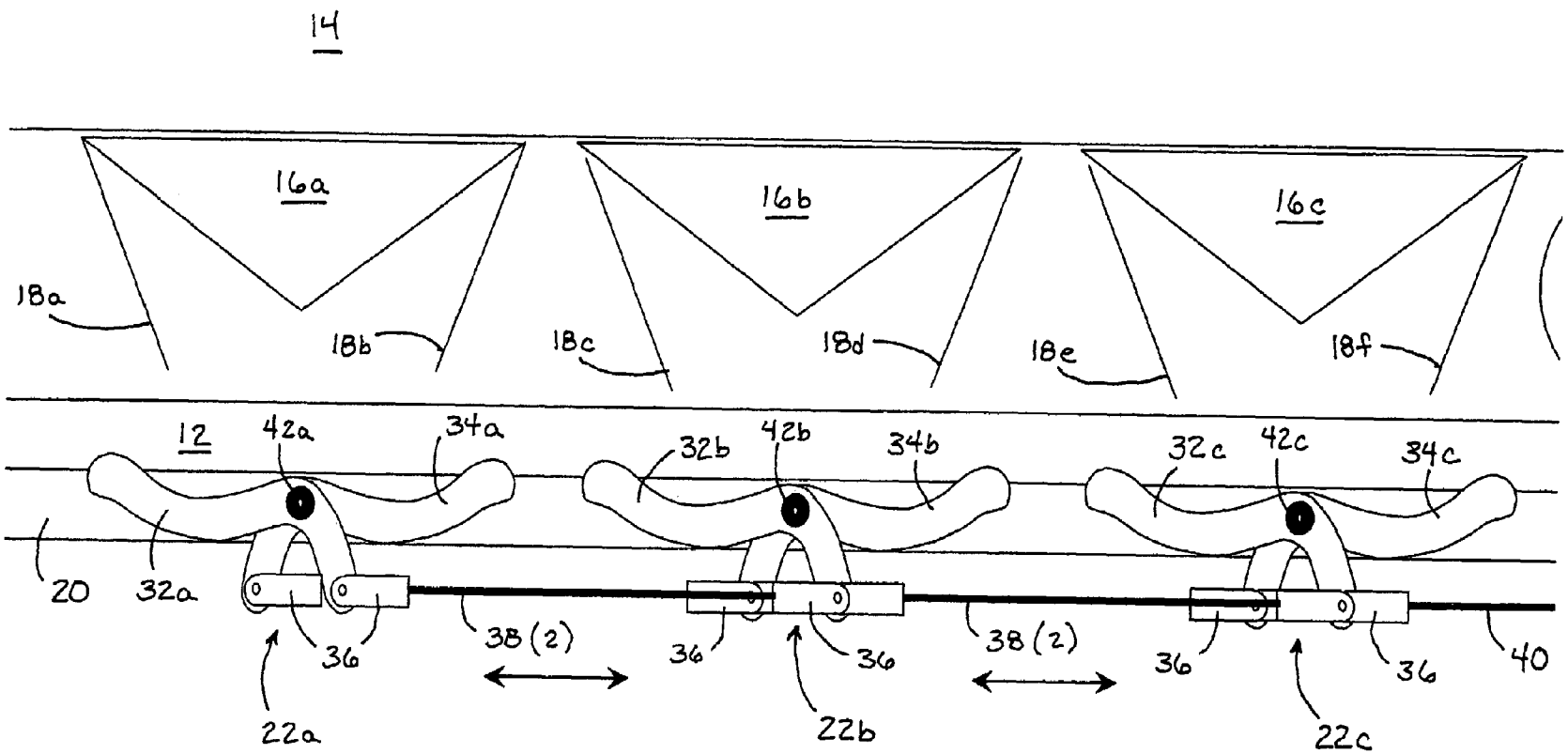
FIG. 2 is a detailed view of the rail car door closer assemblies.

FIG. 2 illustrates a detailed view of the rail car door closer assemblies 22*a*, 22*b* & 22*c*. The left-most members 32*a*, 32*b* & 32*c* of the closer arm assemblies 22*a*, 22*b* & 22*c* are operably connected together by a first push-pull rod linkage 38. The right-most members 34*a*, 34*b* & 34*c* of the closer arm assemblies 22*a*, 22*b* & 22*c* are operably connected together by a second push-pull rod linkage 38 (partially hidden behind the first push-pull rod linkage in this view). Clevis attachment devices 36 pivotally connect the push-pull rods to the closer arm assemblies.

Figure 3:
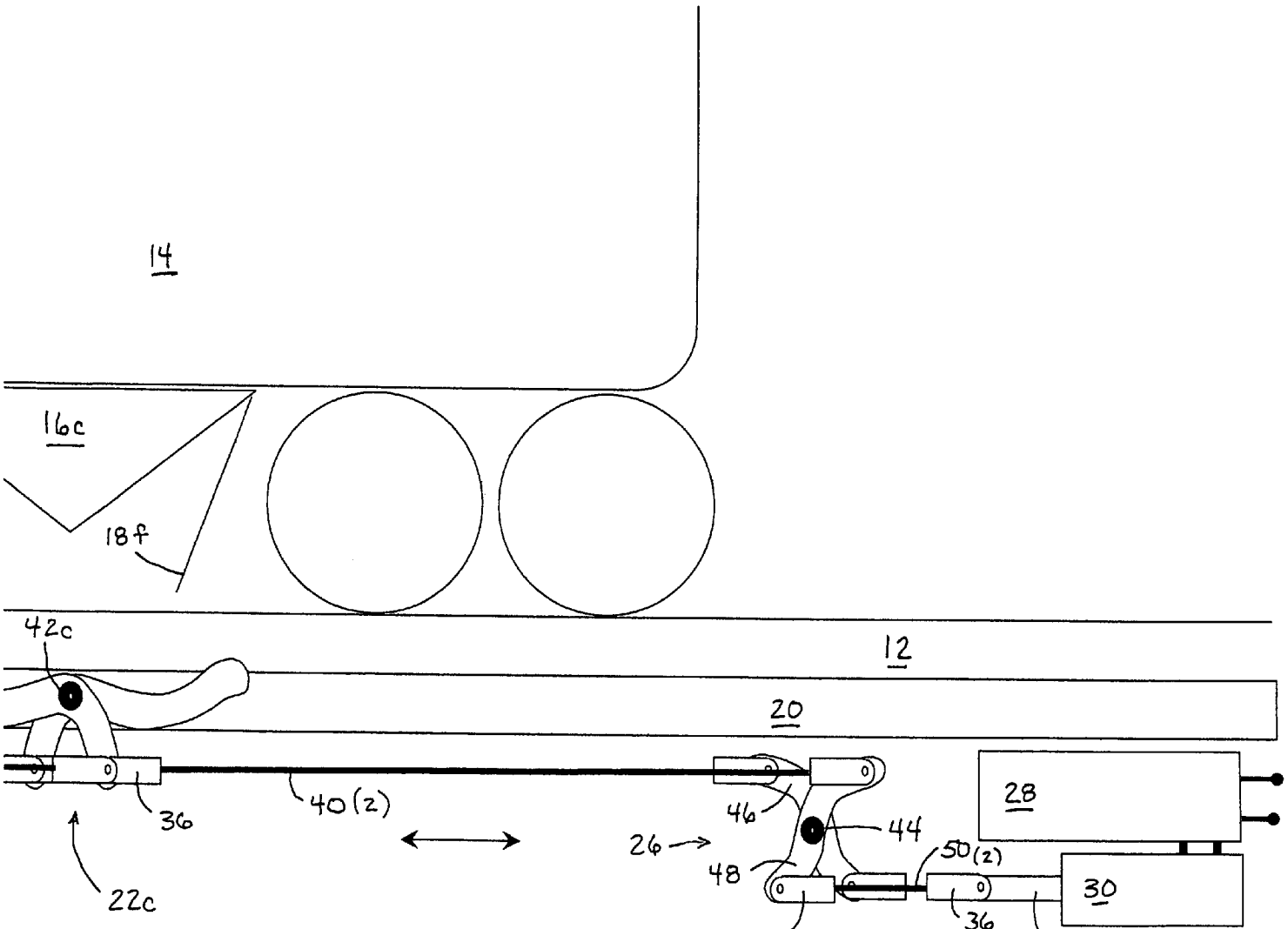
FIG. 3 is a detailed view of the bell crank and hydraulic cylinder assemblies.

FIG. 3 is a detailed view of the bell crank 26 and hydraulic cylinder 30 assemblies wherein the closer arm assemblies (22*c* shown) are connected to the bell crank 26 through the push-pull rod linkage 40. The bell cranks 26 (two in the preferred embodiment) are connected to the shafts 52 of hydraulic cylinders 30 (two in the preferred embodiment) and enable the use of a shorter stroke cylinder for the linear actuated motion of the hydraulic cylinders. Operation of the two hydraulic cylinders 30 is by means of hydraulic pumps and valves contained within hydraulic controls 28 as is well known in the art. It is anticipated that a single lever mechanism may be configured to serve as the actuating lever for both the first and second push-pull rod linkages and therefore the alternate operation of the first (left) and then the second (right) side sets of closer arms.

Figure 4A:
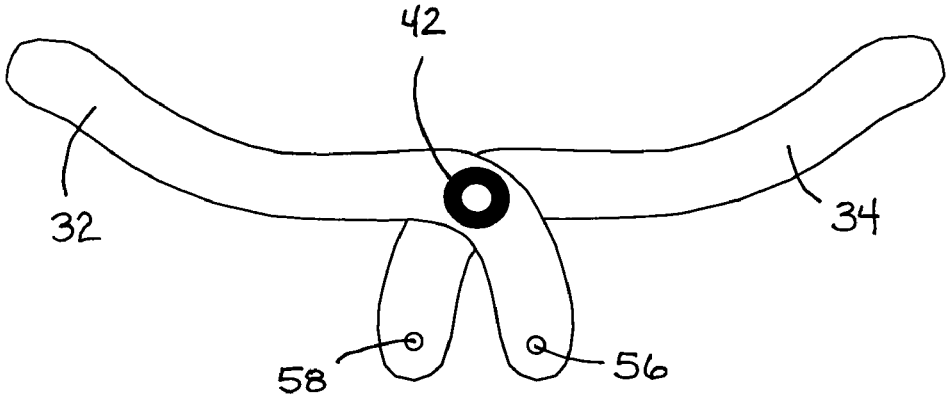
FIGS. 4A–4C are detailed views of the closer arm arrangement options.
Figure 4B:
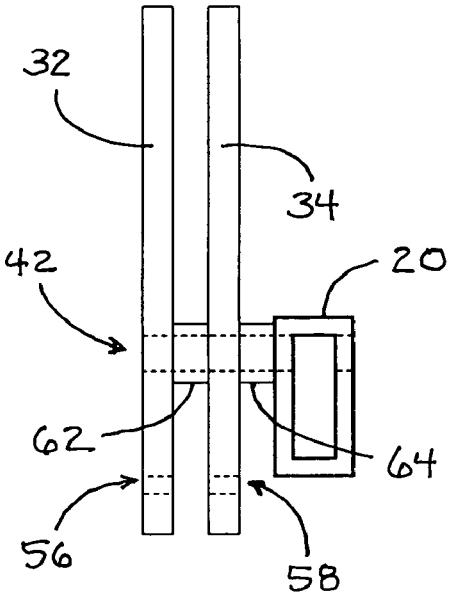
Figure 4C:
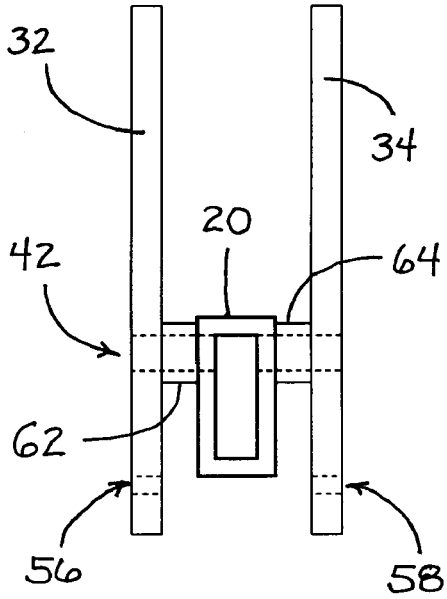

Each of the closer arm mechanisms 22*a*, 22*b* & 22*c* are shown by example in FIGS. 4A–4C in the alternative as either both arms 32 & 34 mounted to one side of the main frame 20 (FIG. 4B) or with one on either side of the main frame 20 (FIG. 4C). The closer arm mounting bolt holes 42 are preferably slotted to allow for adjustment between centers of a pair of closer arms 32 & 34 to further increase the flexibility of adapting to different types of hopper doors. Clevis bolt holes 56 & 58 are shown positioned on one end of each closer arm 32 & 34 for connection to the push-pull rod linkage assemblies. Welded bosses 62 & 64 are shown to position and space apart the closer arms 32 & 34.

Figure 5A:
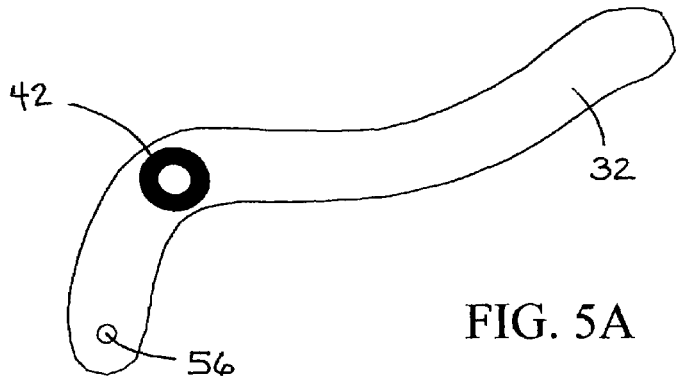
FIGS. 5A–5E are detailed views of the rail car door closer arms and frame attachment structures of the present invention.
Figure 5C:
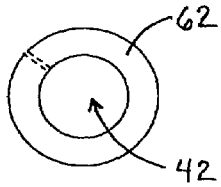
Figure 5D:
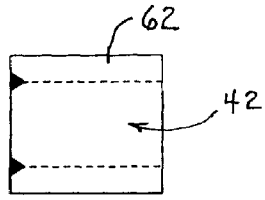
Figure 5B:
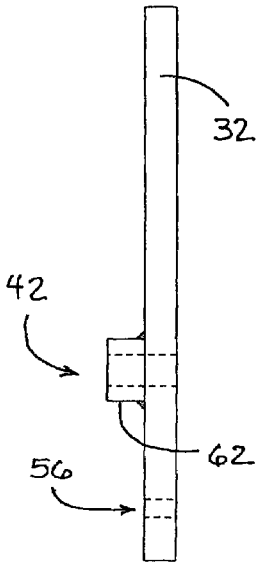
Figure 5E:
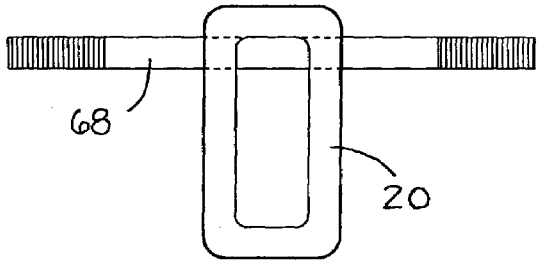
Figure 6A:
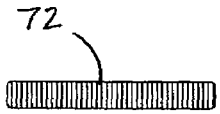
FIGS. 6A–6B are detailed views of the push-pull rod attachment structures.
Figure 6B:
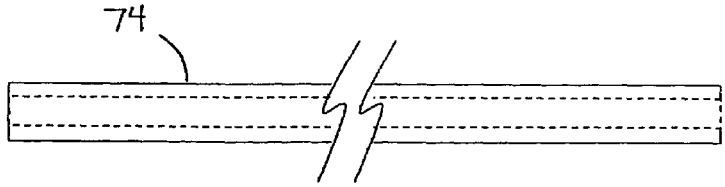

Continuing in FIGS. 5A–5E, the main frame structure 20 is illustrated as well as the details of the closer arm structure 32 with the clevis mounting hole 56 and the welded boss 62 for the pivot point 42 on the closer arm 32. 1" by 2" tubing 74 cut to length is shown in FIGS. 6A & 6B for connection of the push-pull rods to the closer arms via 1" threaded bolts 72 which are cut to length and welded to the push-pull rods. As shown in FIG. 5E 1¼" bolts 68 may be used to fasten the closer arms to the main frame 20. A grease fitting 63 may be installed at the boss 62 to provide lubricant for rotation of the closer arm. A pair of 5" bore by 18" stroke hydraulic cylinders may be used to activate the closer arm assemblies although alternative actuating mechanisms as will be apparent to those skilled in the art.

Figure 7A:
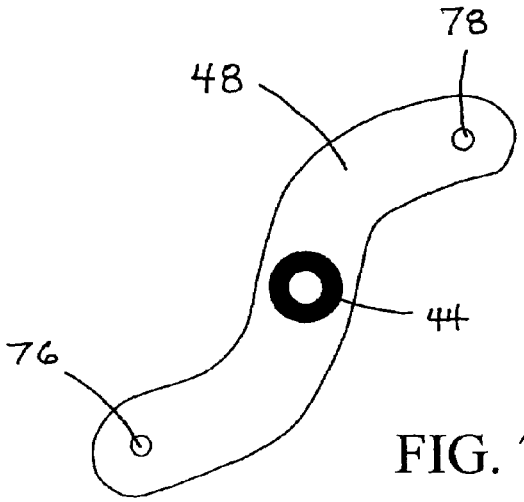
FIGS. 7A–7B are detailed views of the bell crank structures.
Figure 7B:
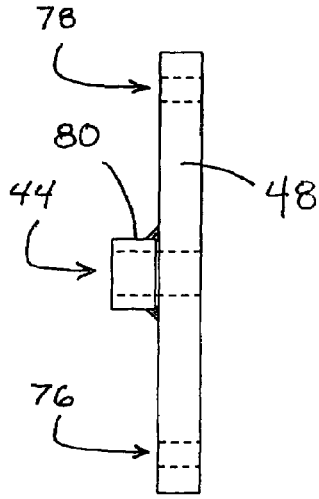
Figure 8:
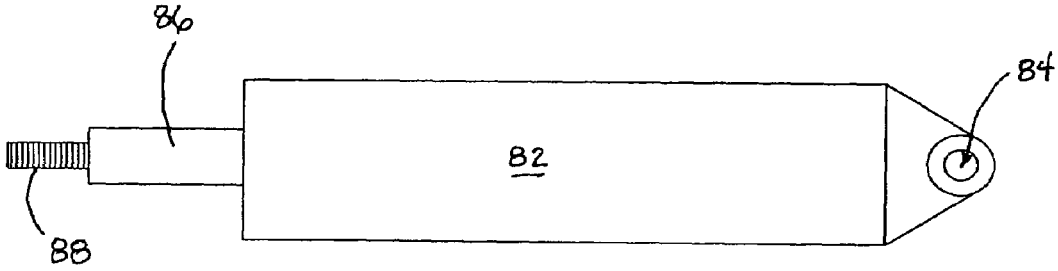
FIG. 8 is a detailed view of the hydraulic cylinder structure.

The detail of bell crank assembly 26 is illustrated in FIGS. 7A & 7B. Clevis mounts are used to attach a first end 76 of each of the bell cranks 48 & 46 to each of the hydraulic cylinders and a second end 78 to the respective push-pull rods. Also shown in FIG. 7B is the welded boss 80 for the bell crank 48 which is essentially the same as that for the closer arm. FIG. 8 illustrates the hydraulic cylinder 82 having a 1" hole 84 for attachment to the clevis mount (not shown).

Figure 9A:
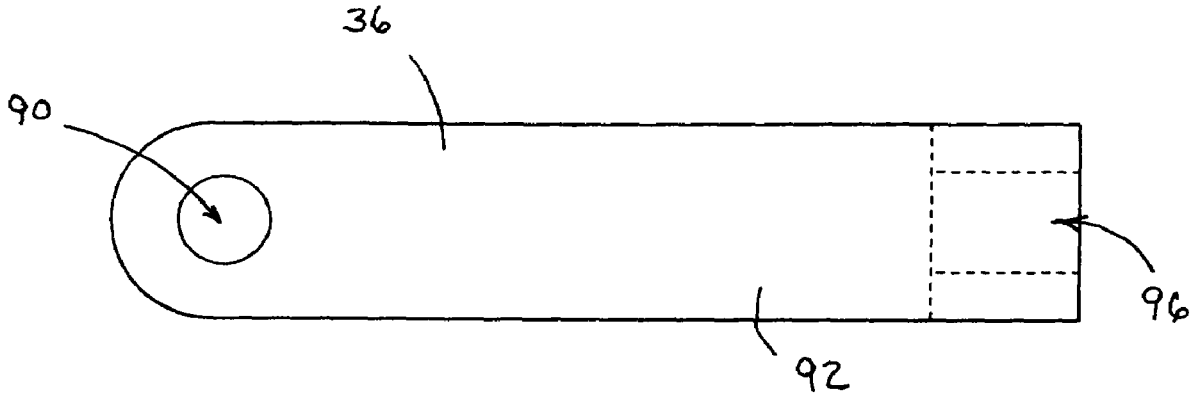
FIGS. 9A–9B are detailed views of the clevis mount structure.
Figure 9B:
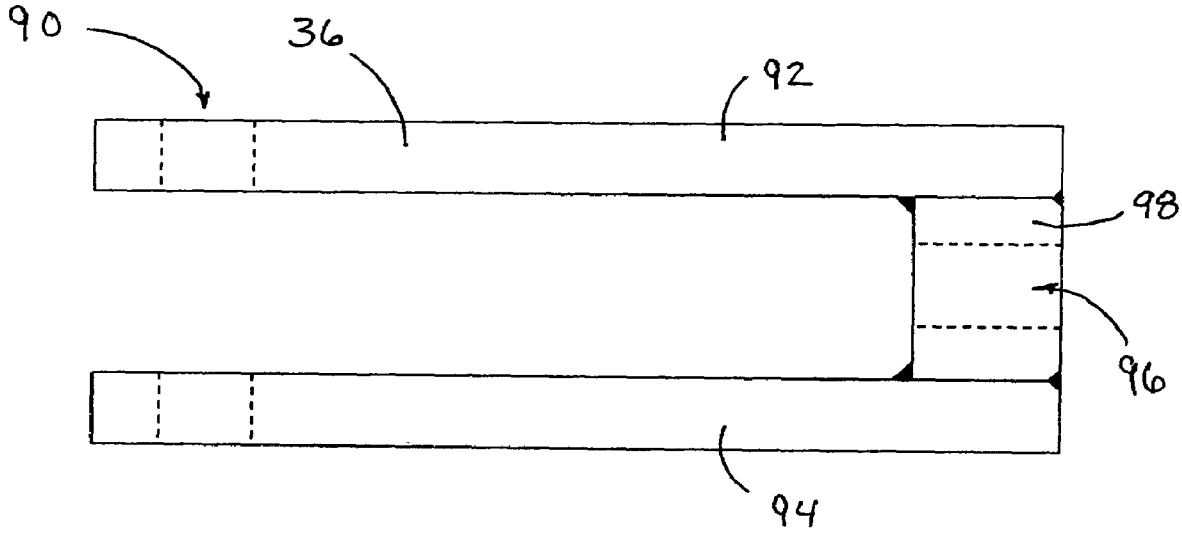

FIGS. 9A–9B illustrate the details of the clevis mount connectors 36 which may preferably be manufactured from ½" by 2" flat strap (92 & 94) and one and a quarter square stock (98). One end of the clevis mount connector 36 has a 1" threaded hole 96 with a 1" back-up nut (not shown), while the other end has an orthogonally directed 1" diameter hole 90. The clevis mount connector 36 is used to connect the closer arm assemblies 22*a*, 22*b* & 22*c* and the bell crank assembly 26 to the push-pull rod assemblies 38 & 40.

The system has been disclosed herein by reference to its preferred embodiment. It is anticipated that those skilled in the art will recognize modifications and extensions of the present invention described above that fall within the scope of the invention.

I claim:

1. A system for simultaneously closing multiple hopper doors on a rail car, the system positioned in fixed association with a section of track on to which the rail car may be moved, the system comprising:

a plurality of closer arm assemblies positioned in fixed association with at least one rail of the section of track and rotationally operable to make contact with and close the hopper doors when the rail car is positioned on the section of track;

a linkage assembly connecting the closer arm assemblies together and linearly operable to direct the rotational movement of the closer arm assemblies in concert;

a bell crank assembly connected to the linkage assembly and rotationally operable to direct the linear movement of the linkage assembly; and a linear actuator connected to the bell crank assembly and linearly operable to direct the rotational movement of the bell crank assembly.

2. The system of claim 1 wherein the plurality of closer arm assemblies each comprise:

left hand and right hand opposing closer arms, the opposing closer arms each rotatable about a common intermediate pivot, the closer arms each having a free end moveable in a large arc so as to contact and close the hopper doors associated therewith, the closer arms each further having a linkage end distal from the respective free end thereof, the linkage ends of the closer arms moveable in a small arc and pivotally connected to the linkage assembly.

3. The system of claim 2 wherein the linkage assembly comprises a first set of push-pull rods connecting together the left hand closer arms of each of the closer arm assemblies and a second set of push-pull rods connecting together the right hand closer arms of each of the closer arm assemblies.

4. The system of claim 3 wherein the bell crank assembly comprises a left hand bell crank connected to the first set of push-pull rods of the linkage assembly and a right hand bell crank connected to the second set of push-pull rods of the linkage assembly.

5. The system of claim 1 wherein the linear actuator comprises a hydraulic cylinder.

6. The system of claim 1 wherein the linear actuator comprises a pneumatic cylinder.

7. The system of claim 1 wherein the linear actuator comprises an electric motor having a screw-drive gear assembly.

8. The system of claim 1 wherein the linkage assembly comprises a plurality of rigid rods extending between clevis end fasteners, the clevis end fasteners pivotally connected to said closer arm assemblies.

9. The system of claim 1 further comprising a frame beam extending parallel to and adjacent the section of track, the frame beam comprising a longitudinal beam with a plurality of pivot bolts extending orthogonal thereto, the pivot bolts serving as attachment points and as pivot points for the rotational operation of the closer arm assemblies.

10. The system of claim 2 wherein the rail car hopper doors are arranged in opposing pairs and the left hand closer arms operate in concert to simultaneously close the hopper doors oriented in a first direction and the right hand closer arms operate in concert to simultaneously close the hopper doors oriented in a direction opposing the first direction.

* * * * *